United States Patent [19]

Engeler

[11] 4,156,284

[45] May 22, 1979

[54] SIGNAL PROCESSING APPARATUS

[75] Inventor: William E. Engeler, Scotia, N.Y.

[73] Assignee: General Electric Company, Schenectady, N.Y.

[21] Appl. No.: 853,116

[22] Filed: Nov. 21, 1977

[51] Int. Cl.[2] ..... G06G 7/16

[52] U.S. Cl. ..... 364/862; 307/221 D; 357/24; 364/841

[58] Field of Search ..... 364/819, 820, 824, 862, 364/827, 844, 841; 357/24; 307/221 C, 221 D; 328/167

[56] References Cited

U.S. PATENT DOCUMENTS

| | | | |
|---|---|---|---|
| 3,492,470 | 1/1970 | Gorbatenko | 364/819 |
| 3,999,152 | 12/1976 | Sato et al. | 307/221 D |
| 4,032,867 | 6/1977 | Engeler et al. | 307/221 D |
| 4,071,775 | 1/1978 | Hewes | 357/24 |
| 4,084,256 | 2/1977 | Engeler et al. | 364/862 |

*Primary Examiner*—Felix D. Gruber

*Attorney, Agent, or Firm*—Julius J. Zaskalicky; Joseph T. Cohen; Marvin Snyder

[57] ABSTRACT

Apparatus for performing matrix mutiplication of a plurality (n) of input signals by a matrix of fixed coefficients ($\alpha_{nm}$) to provide a plurality (m) of output signals, all of which are simultaneously available, is described.

9 Claims, 13 Drawing Figures

INPUT SIGNAL NO 1
0
V1

INPUT SIGNAL NO 6
0
V6

INPUT SIGNAL NO 7
0

INPUT SIGNAL NO 8
0
V7
V8

TIMING VOLTAGE Ø1
0

TIMING VOLTAGE Ø2
0

OUTPUT SIGNAL NO 1
0

OUTPUT SIGNAL NO 8
0

TIMING VOLTAGE Ø3
0 t0 t1 t2 t3 t4 t5 t6

SIGNAL PROCESSING APPARATUS

BACKGROUND OF THE INVENTION

The present invention relates in general to apparatus for performing matrix multiplication of a plurality (n) of input signals by a matrix of fixed coefficients ($\alpha_{nm}$) to provide a plurality (m) of output signals, all of which are simultaneously available.

This application relates to improvements in the apparatus of copending patent application Ser. No. 852,501, filed Nov. 17, 1977 and assigned to the assignee of the present application.

Many signal processing applications such as deriving the Fourier spectrum of a signal require complex calculations. For example, to obtain the discrete Fourier transform consisting of a plurality of output data points of an analog signal, a series of samples of the input signal are multiplied by a matrix of fixed coefficients having as many fixed coefficients in a row as in a column of the matrix to provide a corresponding series of output signals representing the various frequency components of the analog signal. Heretofore, such calculations were performed by digital computing apparatus involving a multiplicity of calculations as well as a multiplicity of conversions of analog to digital data prior to performance of the multiplying calculations, and subsequently converting the digital data to analog data after the desired calculations has been performed. Such a method of implementing matrix multiplying signal processing operations is slow and requires considerable apparatus.

SUMMARY OF THE INVENTION

Accordingly, an object of the present invention is to provide signal processing apparatus of the character described for calculating complex signal processing functions which is simple.

Another object of the present invention is to provide matrix multiplying signal processing apparatus which operates directly on analog data and provide directly outputs in analog form.

A further object of the present invention is to provide matrix multiplying signal processing apparatus which is fast in operation to provide the desired operations.

In carrying out the invention in one illustrative embodiment thereof, there is provided a plurality of capacitive elements arranged in a two-dimensional matrix of rows and columns. Each capacitive element includes a first capacitor having a common electrode and a first electrode, and a second capacitor having a common electrode and a second electrode with the common electrodes of the capacitors being connected together. Each capacitive element has a fixed weighting coefficient of a magnitude equal to the difference in the capacitances of the first and second capacitors thereof and having a sign dependent on the relative magnitude of the capacitances of the first and second capacitors. A plurality of column lines are provided. The common electrodes of the capacitive elements in each column of capacitive elements are connected to a respective column line. A plurality of pairs of row lines are provided, each pair including a positive line and a negative line. The first electrodes of the capacitive elements in each row are connected to the positive line of a respective pair of row lines. The second electrodes of the capacitive elements in each row are connected to the negative line of a respective pair of row lines. Means are provided during a first interval of time for setting the positive row lines to first potentials and setting the negative row lines to second potentials while connecting each of the column lines to a respective third potential thereby to charge the capacitive elements. Means are provided during the latter part of the first interval of time for disconnecting the column lines from the third potentials. Means are provided after the end of the first interval of time for increasing the potential of each of the positive row lines by an amount equal to a respective one of a plurality of analog input voltages and for decreasing the potential of each of the negative row lines by an amount equal to a respective one of the analog input voltages, whereby an output signal is produced on each of the column lines. The output signal is proportional to the algebraic sum of a plurality of partial outputs, each partial output being proportional to the product of the fixed weighting coefficient of a respective capacitive element and a respective analog input voltage.

BRIEF DESCRIPTION OF THE DRAWINGS

The novel features which are believed to be characteristic of the present invention are set forth with particularity in the appended claims. The invention itself, both as to its organization and method of operation, together with further objects and advantages thereof, may best be understood by reference to the following description taken in connection with the accompanying drawings wherein:

DESCRIPTION OF THE PREFERRED EMBODIMENTS

Figure 1:
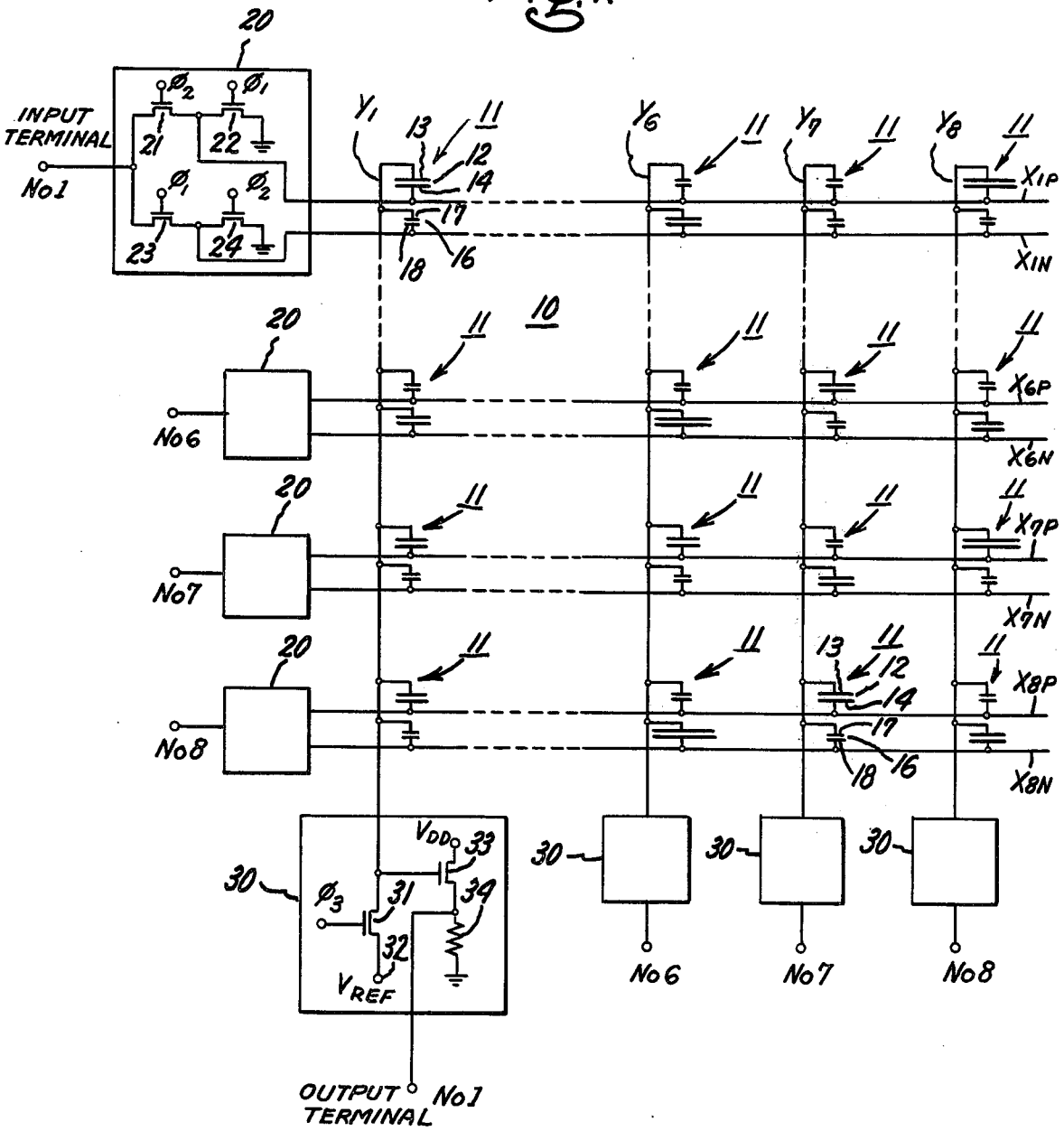
FIG. 1 is a schematic diagram of one embodiment of a matrix multiplier in accordance with the present invention.

Reference is made to FIG. 1 which shows matrix multiplying signal processing apparatus 10 for multiplying a series of input signals $V_1$–$V_8$by a matrix of fixed coefficients $\alpha_{nm}$ to provide a corresponding series of output signals, $V_{01}$–$V_{08}$ such as, for example, would be suitable for the calculation of an eight point discrete Fourier transform. The apparatus 10 comprises a plurality of capacitive elements 11 arranged in a two-dimensional matrix of rows and columns. Each capacitive element 11 includes a first capacitor 12 having a common electrode 13 and a first electrode 14, and also includes a second capacitor 16 having a common electrode 17 and a second electrode 18 with the common electrodes 13 and 17 connected together. Each capacitive element 11 provides a fixed weighting coefficient ($\alpha_{nm}$) having a magnitude equal to the difference in capacitance of the first and second capacitors 12 and 16, and having a sign dependent on the relative magnitude of the capacitances of the first and second capacitors 12 and 16. When the capacitance of capacitor 12 is larger than the capacitance of capacitor 16, the weighting coefficient has a positive sign and, conversely, when the capacitance of capacitor 16 of a capacitive element is greater than the capacitance of capacitor 12, the weighting coefficient has a negative sign. A plurality of column lines are provided. Only the lines for columns 1, 6, 7 and 8 are shown and are designated respectively $Y_1$, $Y_6$, $Y_7$ and $Y_8$. The common electrode of the capacitive elements 11 in each column of capacitive elements is connected to a respective column line. A plurality of pairs of row lines are also provided, only four pairs of which are shown, namely, the pairs for rows 1, 6, 7 and 8. Each pair of row lines includes a positive line and a negative line. The positive lines are denoted $X_{1P}$, $X_{6P}$, $X_{7P}$ and $X_{8P}$ for the four rows shown, and similarly the negative lines are designated $X_{1N}$, $X_{6N}$, $X_{7N}$ and $X_{8N}$ for the four rows shown. The first electrodes 14 of the capacitive elements in each row are connected to respective positive lines of the pairs of row lines, and the second electrodes 18 of the capacitive elements 11 in each row are connected to respective negative lines of the pairs of row lines. For example, the first electrodes 14 of the capacitive elements 11 in the first row are connected to the row line $X_{1P}$, and the second electrodes 18 of the capacitive elements 11 of the first row are connected to the negative row line $X_{1N}$.

Figures 5A, 5B, 5C, 5D, 5E, 5F, 5G, 5H, 5I:
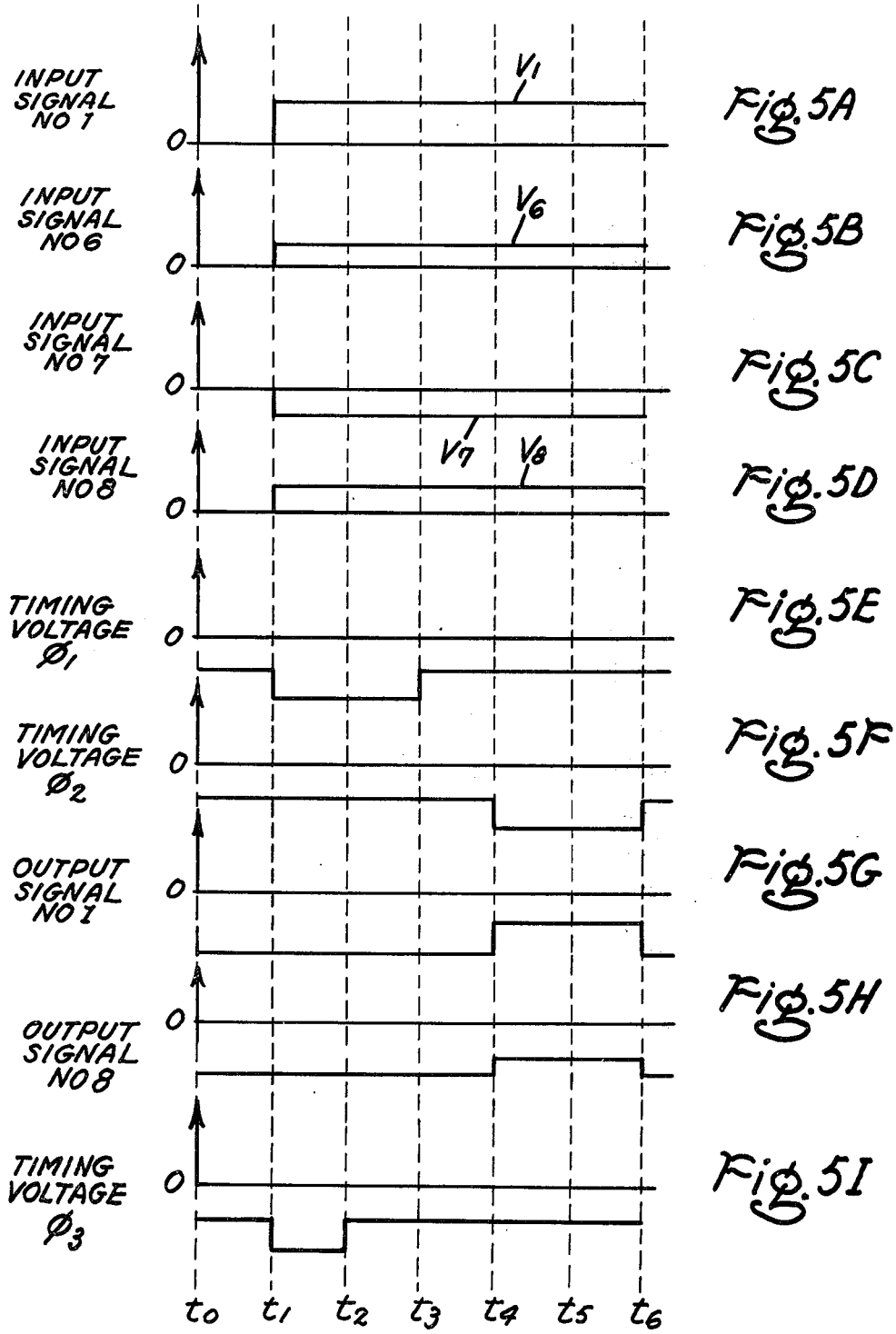
FIGS. 5A—5I shows diagrams of amplitude versus time of voltage waveforms occurring at various points in the apparatus of FIG. 1 useful in explaining the operation thereof.

Eight input terminals are provided, only four of which are shown, namely, input terminals Nos. 1, 6, 7 and 8. Eight input switching circuits 20 are provided, only four of which are shown, for connecting each of the input terminals to a respective pair of row lines. The details of the switching circuit are shown in connection with the input switching circuit for the first row. The circuits 20 for rows 2–8 are identical to the circuit 20 of the first row and are identically connected to the row lines of rows 2–8. The input switching circuit 20 includes a first field effect transistor 21 and a second field effect transistor 22 having their source to drain conduction paths connected in series in the order named between the input terminal No. 1 and ground. The junction point of the conduction paths of the first and second transistors 21 and 22 is connected to the positive row line $X_{1P}$. The input switching circuit also includes a third field effect transistor 23 and a fourth field effect transistor 24 having their source to drain conduction paths connected in the order named between the input terminal No. 1 and ground. The junction point of the conduction paths of the third and fourth transistors 23 and 24 is connected to the negative row line $X_{1N}$. A timing voltage denoted $\phi_1$ is applied to the gate electrodes of the second and third transistors 22 and 23, and another timing voltage $\phi_2$ is applied to the gate electrodes of the first transistor 21 and the fourth transistor 24. The timing voltages $\phi_1$ and $\phi_2$ are shown in FIGS. 5E and 5F and will be further described in connection with the description of the operation of the apparatus.

Eight output terminals are provided in the apparatus 10, only four terminals of which are shown, namely, output terminals Nos. 1, 6, 7 and 8. Eight output switching circuits 30 are also provided. only four of which are shown, with the output circuit connected between output terminal No. 1 and column line $Y_1$ being shown in detail. The circuits 30 for columns 2–8 are identical to the circuit 30 of the first column and are identically connected to column lines $Y_2$–$Y_8$. The output switching circuit 30 includes a transistor 31 having a source connected to a point 32 to which a reference potential $V_{ref}$ is applied and having a drain connected to column line $Y_1$. The gate of the transistor 31 is connected to a source of timing voltage $\phi_3$. Output appearing on the column $Y_1$ is provided to the output terminal No. 1 through a source follower circuit. The source follower circuit includes a transistor 33 with its drain connected to a source of drain potential $V_{DD}$ and having its source connected through a resistance 34 to ground. The gate of the transistor 33 is connected to the line $Y_1$ and the source of the transistor 33 is connected to the output terminal No. 1.

Figure 2:
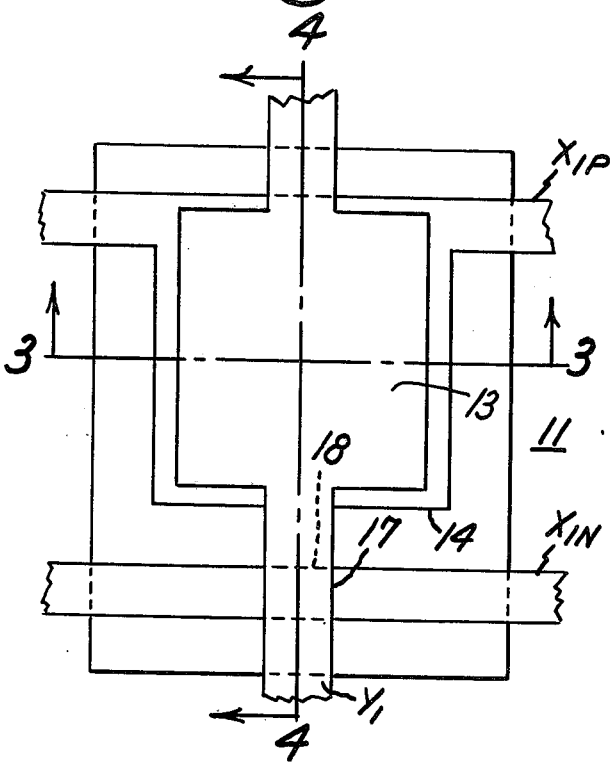
FIG. 2 shows a plan view of a detailed implementation of the capacitive elements of FIG. 1 in accordance with the present invention.
Figure 4:
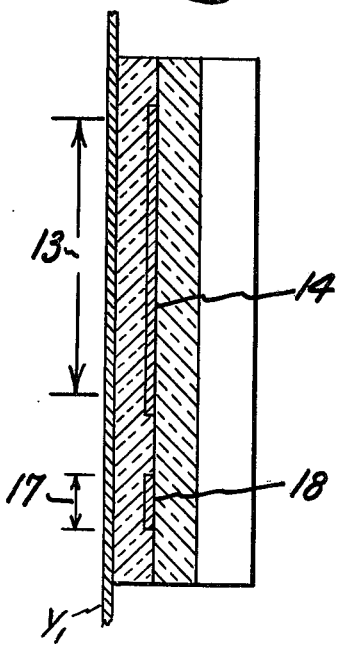
FIG. 4 is a sectional view of the embodiment of FIG. 2 taken along section lines 4—4 of FIG. 2.
Figure 3:
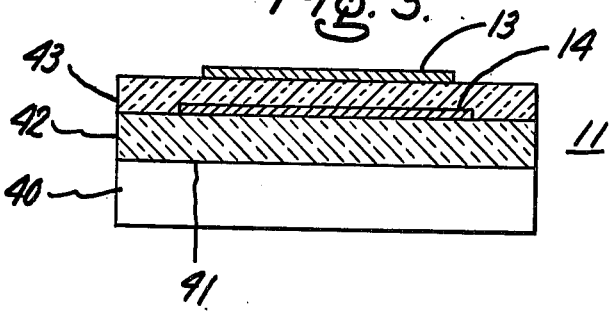
FIG. 3 is a sectional view of the embodiment of FIG. 2 taken along section lines 3—3 of FIG. 2.

Reference is now made to FIGS. 2, 3 and 4 which shows one embodiment of the capacitive elements 11 of FIG. 1. Elements of the structure of FIGS. 2, 3 and 4 identical to the elements shown in FIG. 1 are identically designated. The capacitive elements 11 are formed on a common substrate 40 of, for example, silicon semiconductor material. On a major surface 41 of the substrate 40, a thick layer of insulation 42 which conveniently may be silicon dioxide is provided. The row lines $X_{1P}$ with electrode 14 of the first capacitor 12 connected thereto and row line $X_{1N}$ with the second electrode 18 of the second capacitor 16 connected thereto is provided overlying the thick insulating layer 42. The row lines $X_{1P}$ and $X_{1N}$ along with the capacitor electrodes may be constituted of polycrystalline silicon suitably doped with, for example, boron or phosphorus, to provide relatively good electrical conductivity therein. A layer of thin insulation 43 is provided overlying the row lines and electrodes. Column line $Y_1$ with common electrode 13 of the first capacitor 12 and with common electrode 17 of the second capacitor 16 of the capacitive element 11 is provided overlying the thin layer of insulation 43. The material of the column line $Y_1$ and associated capacitor electrodes may conveniently be constituted of a good conductive material, such as aluminum.

The operation of the matrix multiplying signal processing circuit of FIG. 1 will now be explained in connection with the waveform diagrams of FIGS. 5A through 5I. FIGS. 5A through 5D show, respectively, the input signals $V_1$, $V_6$, $V_7$ and $V_8$ applied to terminal Nos. 1, 6, 7 and 8 of the apparatus. These signals may represent the amplitudes of a time sequence of samples of a time varying analog signal for which it is desired to calculate or obtain an 8-point discrete Fourier transform. The magnitude and sign of the fixed weighting coefficients ($\alpha_{nm}$) represented by the capacitive elements 11 are preset or preprogrammed by appropriately proportioning of the first and second capacitors of each of the elements to provide the appropriate weighting, as explained above. During a first interval of time designated $t_1$ to $t_3$, the timing voltage $\phi_1$ goes negative and turns on transistor switches 22 and 23. Thus, the positive row line $X_{1P}$ as well as the other positive row lines are connected to ground, and negative row line $X_{1N}$ is connected to a potential $V_1$. Similarly, row lines $X_{2N}$–$X_{8N}$ are connected, respectively, to potentials $V_2$–$V_8$. Also, during the first part of the first interval, $t_1$ to $t_2$, the transistor 31 is turned on by timing voltage $\phi_3$ and accordingly the column line $Y_1$ is connected to a voltage $V_{ref}$. Similarly, the other column lines are connected to voltage $V_{ref}$. Thus, during the first interval of time, $t_1$ to $t_3$, fixed voltages are applied to all of the row lines and during the first part, $t_1$–$t_2$, of this interval a fixed voltage $V_{ref}$ is applied to all of the column lines. Thus, all of the capacitive elements 11 are charged to different but fixed potential differences or voltages. At the end of the first part of the first interval the voltage $\phi_3$ rises toward ground and turns off transistor 31 leaving all of the column lines charged, but in a floating condition. During the first part, $t_3$–$t_4$, of a second interval of time, $t_3$ to $t_6$, the transistor switches 22, 23 and 31 are turned off. Thus, all of the capacitive elements 11 are disconnected from sources of charging voltage and are thus floating. During a second part of the second interval, shown as $t_4$ through $t_6$, the timing voltage $\phi_2$ goes negative and transistors 21 and 24 are turned on. Thus, the positive row line $X_{1P}$ and the other positive row lines as well are now connected to the input voltages $V_1$–$V_8$, respectively, while the negative row lines $X_{1N}$–$X_{8N}$ are connected to ground. The column lines $Y_1$–$Y_8$ and the electrodes connected to them remain floating. Thus, opposite but equal steps of voltage are applied to the first and second electrodes of each of the capacitive elements 11 of each of the rows. The steps of voltage for each of the rows is, of course, different depending upon the amplitude of the input signal applied to the input terminal of the row. Of course, if the input signal is negative, then the step of voltage applied to the positive row line would be opposite to that which would be applied for a positive voltage. In the application of opposite steps of voltage to each of the elements 11 of a row, charge is caused to redistribute and establish a voltage level on a column line which is different from the voltage level established during the first interval of time. The change in voltage level of a column line may be represented by the following equation:

$$\Delta V_T = \sum_{j=1}^{n} \left[ \frac{C_J^+ - C_J^-}{C_T} \right] \Delta V_J$$

where $\Delta V_T$ equals the change in voltage on the column line, $C^+_J$ is the capacitance of the first capacitor of the $j^{th}$ capacitive element of the column, $C^-_J$ is the capacitance of the second capacitor the $j^{th}$ capacitive element of the column, $\Delta V_j$ is the step in voltage applied to $j^{th}$ capacitive element of the column, and $C_T$ is the total capacitance on the column line, including any loading or stray capacitance as well as the sum of the first and second capacitors of each of the capacitive elements in that column. Thus, the weighting coefficient $a_{nm}$ equals $(C_J^+ - C_J^-/C_T)$.

In FIG. 5G is shown the output $V_{01}$ appearing on the column line $Y_1$ as seen at the output terminal No. 1. As the capacitive elements in each of the other columns of capacitive elements represents different values of fixed coefficients, the outputs thereon would be different. FIG. 5H shows the output $V_{O8}$ for the eighth column of elements. Thus, over a period of time $t_1$ through $t_6$, eight analog input signals $V_1$–$V_8$ are applied to the apparatus of FIG. 1. During this period of time eight analog outputs $V_{01}$–$V_{08}$ are obtained, each representing the algebraic sum of a plurality of partial outputs, each partial output being proportional to the product of the fixed weighting coefficient of a respective capacitive element and a respective analog input voltage. After one set of output voltages are obtained, a new set of input voltages may be applied to the input terminals and a new set of output voltages obtained. Preferably, the measurement or sampling of the output voltages is taken during the latter portion of the interval $t_4$–$t_6$ after charge transfers on the column lines have settled or stabilized.

In accordance with an important feature of the invention the capacitive elements, the row and column lines, and the input switching circuit 20 and output switching circuit 30 are all formed on a common substrate. In such an integrated structure the portion of the total capacitance $C_T$ which is stray capacitance is kept to a minimum and output signal is increased. Also, in such an integrated structure the capacitance $C_T$ of the column lines are maintained fixed.

Preferably, the sum of the capacitances connected to each of the column lines including the stray capacitances thereof is the same to provide output signals which may be readily compared. This may be achieved by the addition of a balancing capacitor on each of the column lines, or alternatively the sum of the capacitances of the first and second capacitors of each capacitive element can be made the same.

While during the first interval of time a single second fixed potential, namely ground, is applied to all of the negative row lines and a single third fixed potential is applied to all of the column lines, it will be understood that each of the second fixed potentials could be different and also each of the third fixed potentials could be different, if desired.

While in the apparatus of FIG. 1–4 the capacitive elements were implement in a specific structure, it is apparent that the capacitive elements could be implemented in other structures.

While a particular input switching circuit 20 has been described, it is apparent that other input switching circuits could be provided to achieve the same switching function.

While a particular output circuit 30 has been described, it is apparent that other output circuits could be provided to achieve the same function.

While in the embodiment of FIG. 1, the output signal obtained on each of the column lines $Y_1$–$Y_8$ is in the form of a change in voltage, it is apparent that the voltages on the column lines may be kept fixed and output signals obtained by sensing the charges induced on the column lines. One circuit which may be substituted for output circuit 30 to achieve such a mode of operation is described and claimed in U.S. Pat. No. 3,969,636, assigned to the assignee of the present invention, which is incorporated herein by reference thereto.

While the embodiment of FIG. 1 shows an array having eight input and eight output terminals, larger arrays are often desirable. For example, as an eight point Fourier transform requires mathematically complex multiplications, an array having sixteen input and sixteen output terminals would be required. The eight real and the eight imaginary input values would be applied to the sixteen input terminals, and the eight real and the eight imaginary output values would be obtained from the sixteen output terminals. This example illustrates that the apparatus may be employed in applications where complex multiplications are necessary. In general, complex multiplications increase the number of array elements required by a factor of four.

While the invention has been described in a specific embodiment, it will be understood that modifications, such as those described above, may be made by those skilled in the art, and it is intended by the appended claims to cover all such modifications and changes as fall within the true spirit and scope of the invention.

What I claim as new and desire to secure by Letters Patent of the United States is:

1. Signal processing apparatus comprising a plurality of capacitive elements arranged in a two-dimensional matrix of rows and columns, each capacitive element including a first capacitor having a common electrode and a first electrode and a second capacitor having a common electrode and a second electrode, said common electrodes being connected together, each capacitive element providing a respective fixed weighting coefficient of a two-dimensional matrix of fixed weighting coefficients, each fixed weighting coefficient having a magnitude equal to the difference in capacitance of the first and second capacitors of a respective capacitive element and having a sign dependent on the relative magnitude of the capacitances of the first and second capacitors of a respective capacitive element, a plurality of column lines, the common electrodes of the capacitive elements in each column of capacitive elements being connected to a respective column line, a plurality of pairs of row lines, each pair including a positive line and a negative line, the first electrodes of the capacitive elements in each row being connected to the positive line of a respective pair of row lines, the second electrodes of the capacitive elements in each row being connected to the negative line of a respective pair of row lines, first means during a first interval of time for setting each of said positive row lines to a respective first potential of a plurality of first potentials and each of said negative row lines to a respective second potential of a plurality of second potentials while connecting each of said column lines to a respective third potential of a plurality of third potentials thereby to charge said capacitive elements, second means during a second interval of time for increasing the potential of each of said positive row lines by an amount equal to a respective one of a plurality of analog input voltages and for decreasing the potential of each of said negative row lines by an amount equal to a respective one of said analog input voltages, whereby an output signal is produced on each of said column lines, said output signal being proportional to the algebraic sum of a plurality of partial outputs, each partial output being porportional to the product of the fixed weighting coefficient of a respective capacitive element and a respective analog input voltage.

2. The apparatus of claim 1 in which said column lines are disconnected from said third potentials during said second interval of time.

3. The apparatus of claim 2 in which the increasing of the potentials on said positive row lines and the decreasing of the potentials on said negative row lines is timed to occur during a second subinterval after the elapse of a first subinterval of said second interval, whereby each of said output signals is obtained by measuring the difference in voltage on a respective column line during said first and second subintervals.

4. The apparatus of claim 1 in which said first means and said second means includes switching means for setting during said first interval said positive row lines, said negative row lines, and said common electrodes of said capacitive elements, respectively, to said plurality of first potentials, said plurality of second potentials, and said plurality of third potentials, and during said second interval of time for increasing the potential of each of said positive row lines by an amount equal to a respective one of a plurality of analog input voltages and for decreasing the potential of each of said negative row lines by an amount equal to a respective one of said analog input voltages.

5. The apparatus of claim 1 in which the sum of the capacitances of said first and second capacitors of each capacitive element is the same.

6. The apparatus of claim 1 in which a plurality of column capacitors are provided, each having one electrode connected to a respective column line and having the other electrode thereof connected to a fixed potential, the sum of the capacitances of each of the column lines being the same.

7. The apparatus of claim 1 in which each of said output signals is obtained by sensing the change in voltage on a respective column line.

8. The apparatus of claim 1 in which each of said output signals is obtained by sensing the change in induced charge on a respective column line while maintaining the potential thereof constant.

9. The apparatus of claim 1 in which said plurality of capacitive elements, said plurality of row lines and said plurality of column lines are all formed on a common substrate.

* * * * *